US007793995B2

(12) United States Patent
King et al.

(10) Patent No.: US 7,793,995 B2
(45) Date of Patent: Sep. 14, 2010

(54) PUSH/PUSH LATCH

(75) Inventors: Thomas S. King, Evanston, IL (US); Kenneth R. Levey, West Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 549 days.

(21) Appl. No.: 11/821,213

(22) Filed: Jun. 22, 2007

(65) Prior Publication Data

US 2008/0023967 A1 Jan. 31, 2008

Related U.S. Application Data

(60) Provisional application No. 60/833,592, filed on Jul. 27, 2006.

(51) Int. Cl.
*E05B 63/20* (2006.01)
*E05B 63/22* (2006.01)

(52) U.S. Cl. ..... 292/332; 292/DIG. 4; 292/DIG. 22

(58) Field of Classification Search ..... 292/332, 292/DIG. 4, DIG. 22
See application file for complete search history.

(56) References Cited

U.S. PATENT DOCUMENTS

| | | | | |
|---|---|---|---|---|
| 4,383,707 | A * | 5/1983 | Nishimura | 292/110 |
| 4,792,165 | A * | 12/1988 | Nishimura | 292/19 |
| 5,090,751 | A * | 2/1992 | Kobayashi | 292/71 |
| 5,306,081 | A | 4/1994 | Fukumoto | |
| 5,518,223 | A | 5/1996 | Bivens | |
| 5,647,578 | A | 7/1997 | Bivens | |
| 5,657,969 | A | 8/1997 | Bivens | |
| 6,056,333 | A | 5/2000 | Wach | |
| 6,968,601 | B2 | 11/2005 | Bivens et al. | |
| 7,165,790 | B2 * | 1/2007 | Bella et al. | 292/34 |
| 7,607,703 | B2 * | 10/2009 | Cho | 292/304 |
| 2002/0096892 | A1 | 7/2002 | Sato et al. | |
| 2002/0171251 | A1 | 11/2002 | Beck et al. | |
| 2005/0173931 | A1 | 8/2005 | Kulajew | |
| 2005/0255737 | A1 | 11/2005 | Bella et al. | |

FOREIGN PATENT DOCUMENTS

| | | |
|---|---|---|
| DE | 9412661 | 10/1994 |
| EP | 1253271 | 10/2002 |
| EP | 1596030 | 11/2005 |
| WO | WO 03104591 | 12/2003 |

OTHER PUBLICATIONS

International Search Report and Written Opinion for PCT/US2007/015825.

* cited by examiner

*Primary Examiner*—Carlos Lugo
(74) *Attorney, Agent, or Firm*—Mark W. Croll; Paul F. Donovan

(57) ABSTRACT

A push/push latch designed to operate in high and low g-force situations, which may be mounted horizontally or vertically. The latch includes a latch body, a track, a housing surrounding the track and latch body, a follower with a pin that moves in the track to actuate the push/push latch. The invention also includes a hammer that repositions when a g-force is applied to the latch to stop the movement of the track body thus preventing the latch from opening during a g-force situation such as a vehicle crash. The hammer may be connected to the housing or to the latch body.

17 Claims, 14 Drawing Sheets

PUSH/PUSH LATCH

CROSS REFERENCE TO RELATED APPLICATIONS

This Non-Provisional Application claims benefit to U.S. Provisional Application Ser. No. 60/833,592 filed Jul. 27, 2006.

FIELD OF THE INVENTION

The present invention relates generally to latches, and more specifically to push/push latches.

BACKGROUND OF THE INVENTION

It is known that push/push latches (i.e., push to open/push to close latches) are used in various applications to perform various functions. It is further known that numerous types of push/push latches are used in automotive applications. In the automotive industry, push/push latches are used in many applications such as overhead or dashboard compartments. For example, to open an overhead compartment, a user will push on the compartment door which will release the latch holding the compartment causing the compartment to open. A similar pushing action on the compartment will cause the compartment to close and the latch to engage the compartment, thereby holding the compartment in the closed position.

Many different configurations of push/push latches are known. For example, a push/push latch device may include a track, a housing surrounding the track, and a follower with a pin that moves in the track to actuate the push/push latch. Drawbacks exist with respect to known push/push latches. For example, known push/push latches may unlatch when a significantly large force is exerted on them, such as during a vehicle crash. For example, if the latch of an overhead compartment unlatches and the compartment opens during a vehicle crash, the contents of the compartment can become projectiles within the interior of a vehicle. This could cause harm to the occupants or the vehicle.

An effort to overcome this problem has been with a push/push latch that utilizes a blocking plate to prevent the pin from moving in the track during unwanted forces. A drawback with this design is that when subjected to extreme forces, the blocking plate may sever the pin, destroying any future use of the push/push latch. Another known drawback with this design is that due to the weight and size of the blocking plate, during a low force situation, such as a low impact vehicle crash, the plate may not move in a sufficient manner to block the pin to prevent the unlatching or opening of the latch.

The present invention is directed at overcoming these and other known drawbacks with existing push/push latches.

SUMMARY OF THE INVENTION

The present invention is directed to a latch, specifically a push/push latch which may be used in various applications, including in automotive applications. The push/push latch of the invention may be used in high and low g-force situations, such as those generated in high and low impact vehicle crashes. In particular, the invention provides a hammer that includes a counter-weight and that is mounted to the push/push latch to prevent the unlatching or opening of the latch when the latch is subjected to certain forces. The invention will further stop the movement of the latch to allow the latch to remain in its current open or closed position.

Other features and advantages of the invention will become apparent to those skilled in the art upon review of the following detailed description, claims and drawings in which like numerals are used to designate like features.

Figure 1:
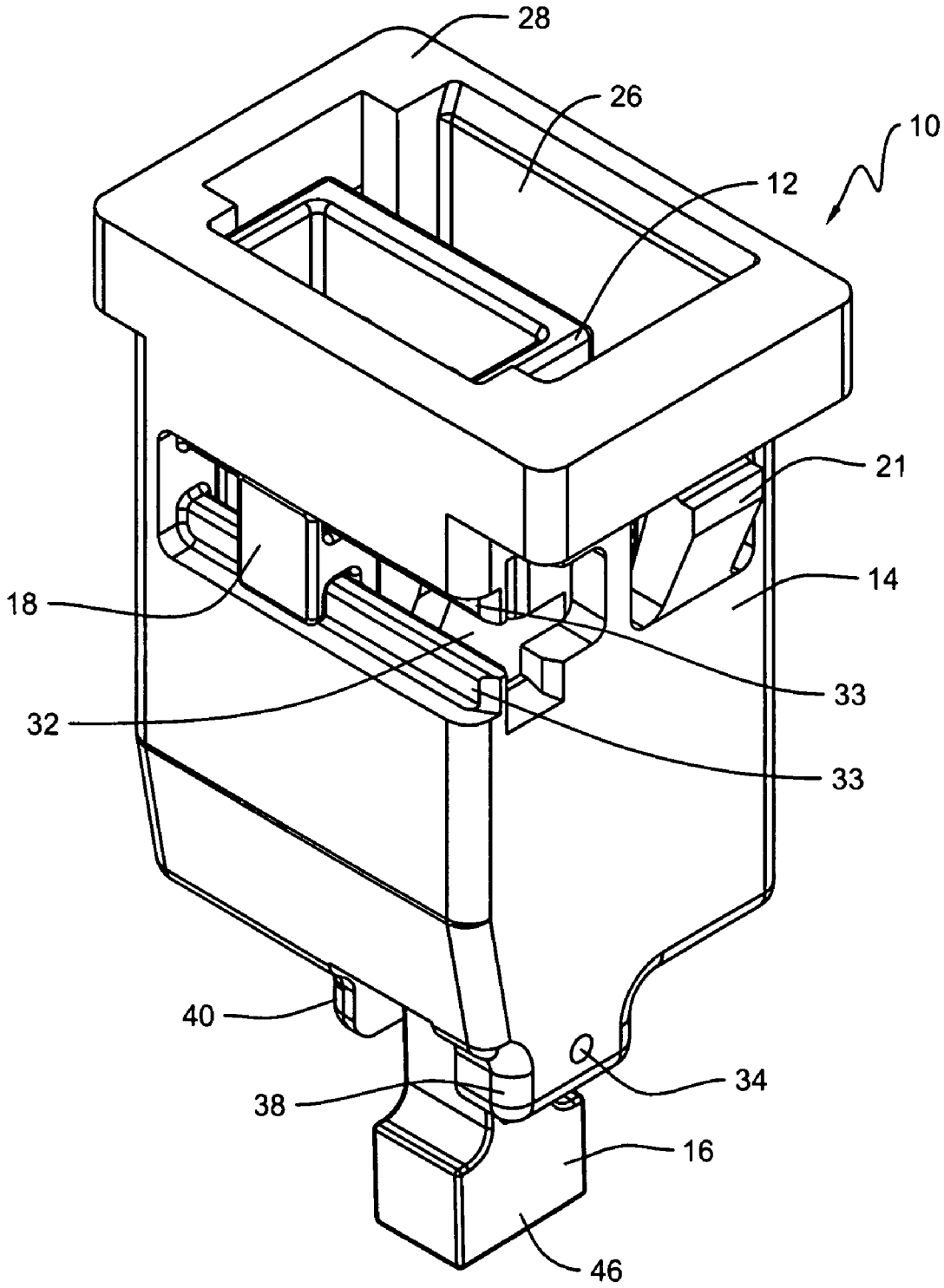
FIG. 1 is an isometric view of an exemplary embodiment of the push/push latch of the invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE EMBODIMENTS

The present invention is directed to a push/push latch and may be embodied in many forms. Generally, the push/push latch of the invention includes a latch body that further defines a track, a housing surrounding the latch body and track, a follower with a pin that is slidably mounted to the housing and that moves in the track to actuate the push/push latch, and a hammer that may define numerous configurations to stop the movement of the latch body in high and low g-force situations, such as a vehicle crash, to thereby prevent the opening of the latch. In the embodiments of the invention, after the g-force has dissipated, the hammer returns to its original or neutral position and the latch will become operational.

More specifically, and referring to FIGS. 1-7, in one exemplary embodiment, the present invention is directed to a push/push latch 10 which may include a latch body 12, a housing 14 encompassing the latch body 12, a hammer 16, a follower 18, and a pin 20. The housing may define numerous housing configurations depending on the application and may include opposing, flexible angled members 21 that are used to snap-fit or otherwise secure the housing and thus the latch 10 to a substrate, such as a panel of a vehicle or other mounting structures. The housing 14 is configured to receive the latch body 12 and to permit slidable movement of the latch body relative to the housing. The slidable movement of the latch body within the housing defines a path of travel.

Figure 2:
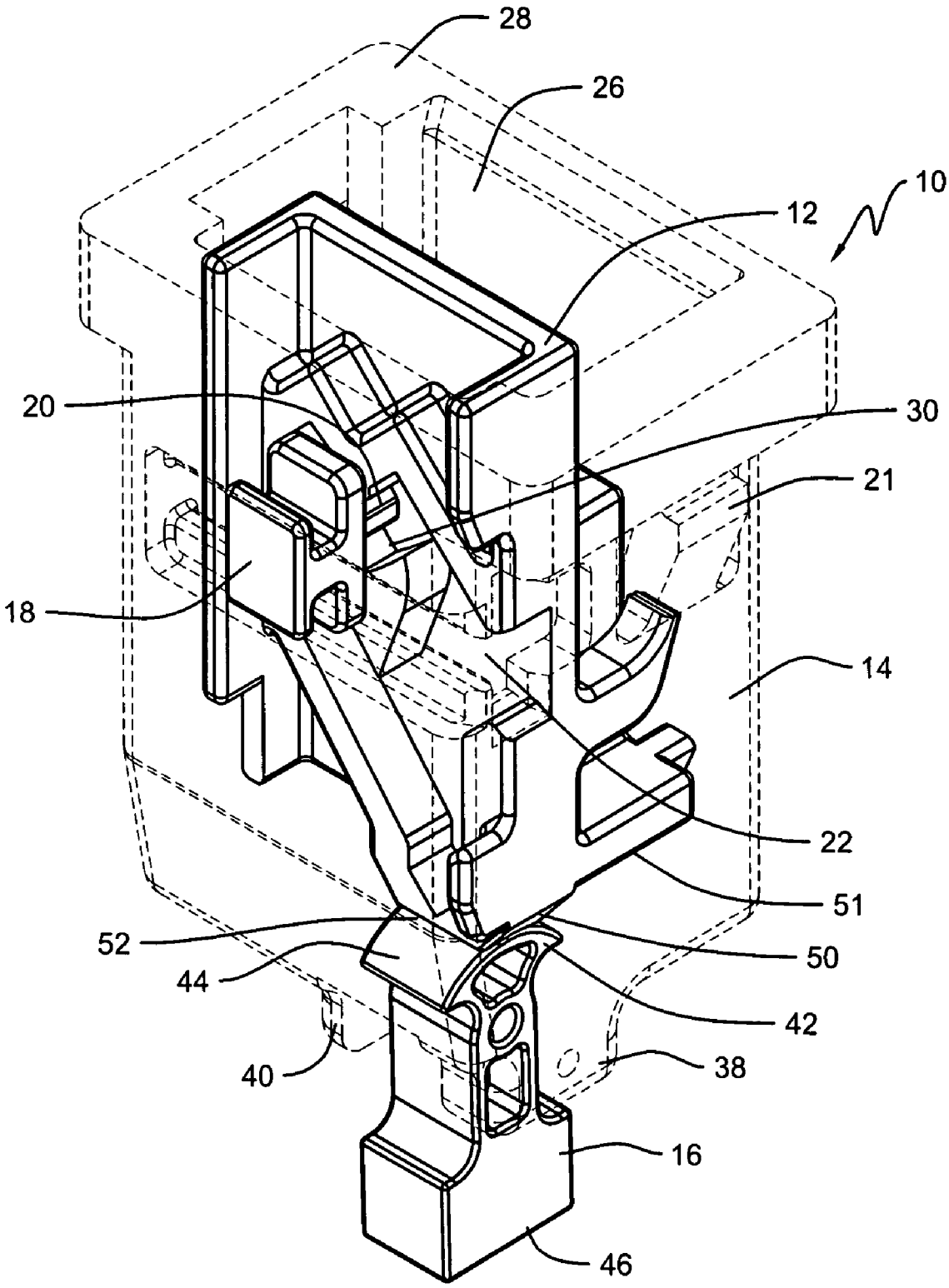
FIG. 2 is another isometric view of the push/push latch of FIG. 1 with the housing transparent to illustrate the latch body.
Figure 3:
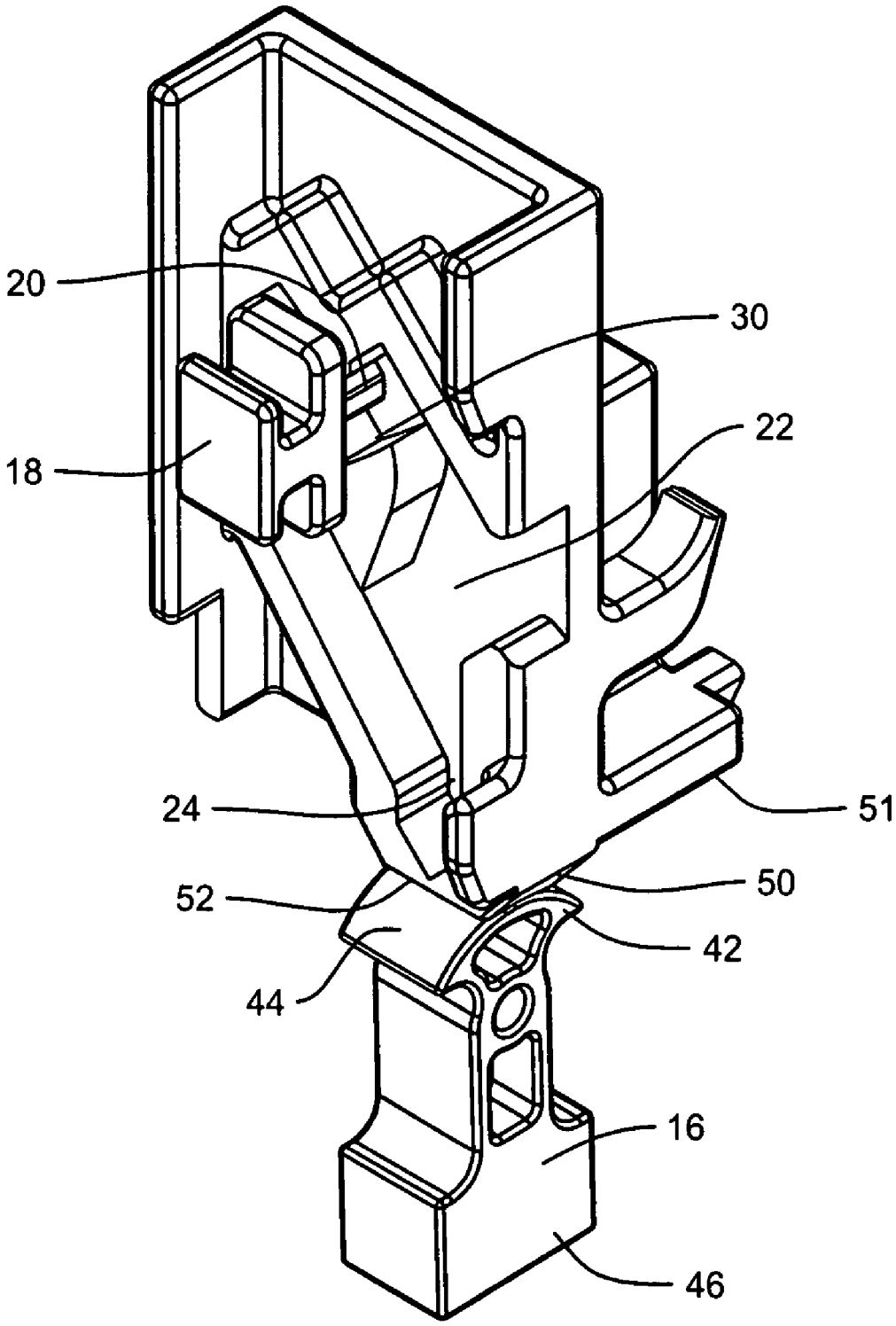
FIG. 3 is an isometric view of the latch body of the push/push latch of FIG. 1.
Figure 4:
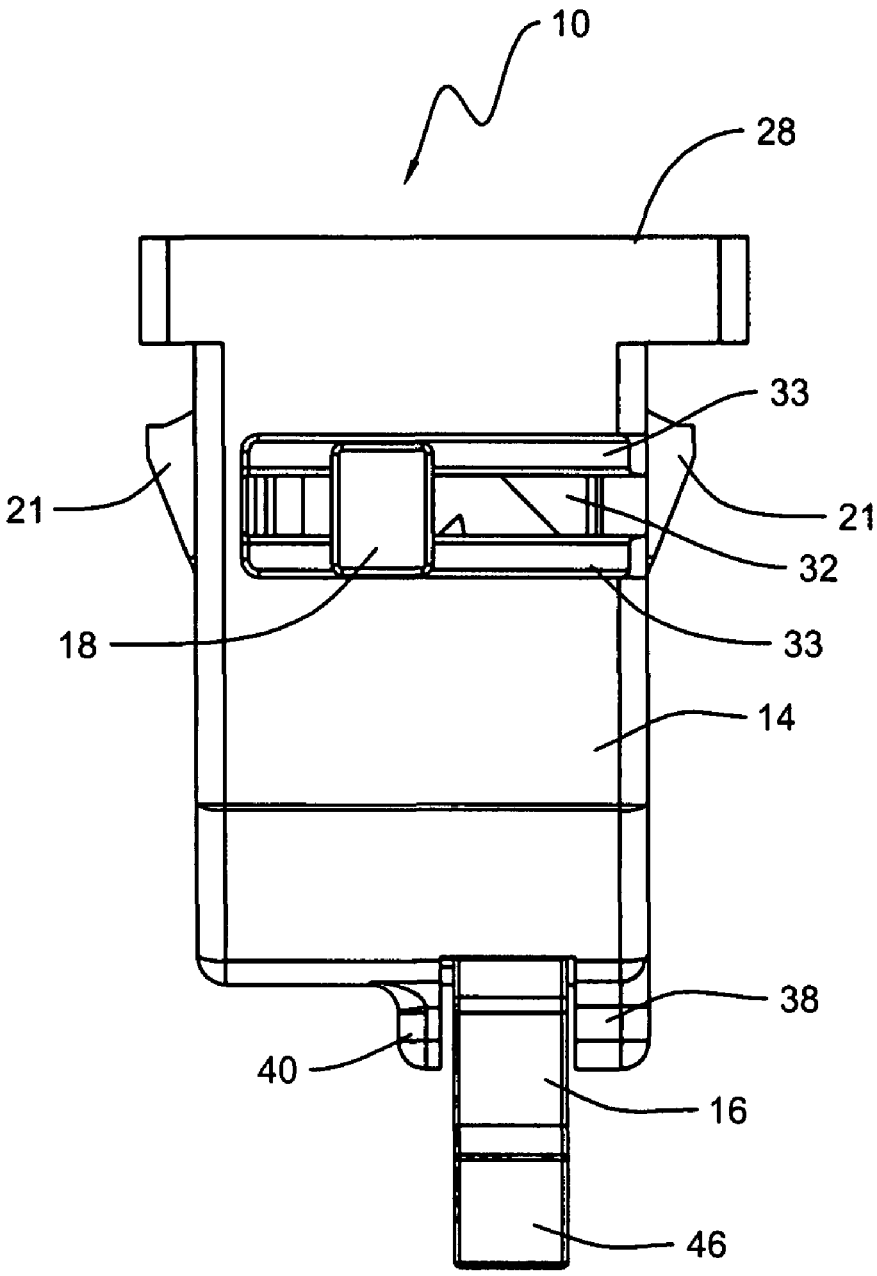
FIG. 4 is a side view of the push/push latch of FIG. 1.
Figure 5:
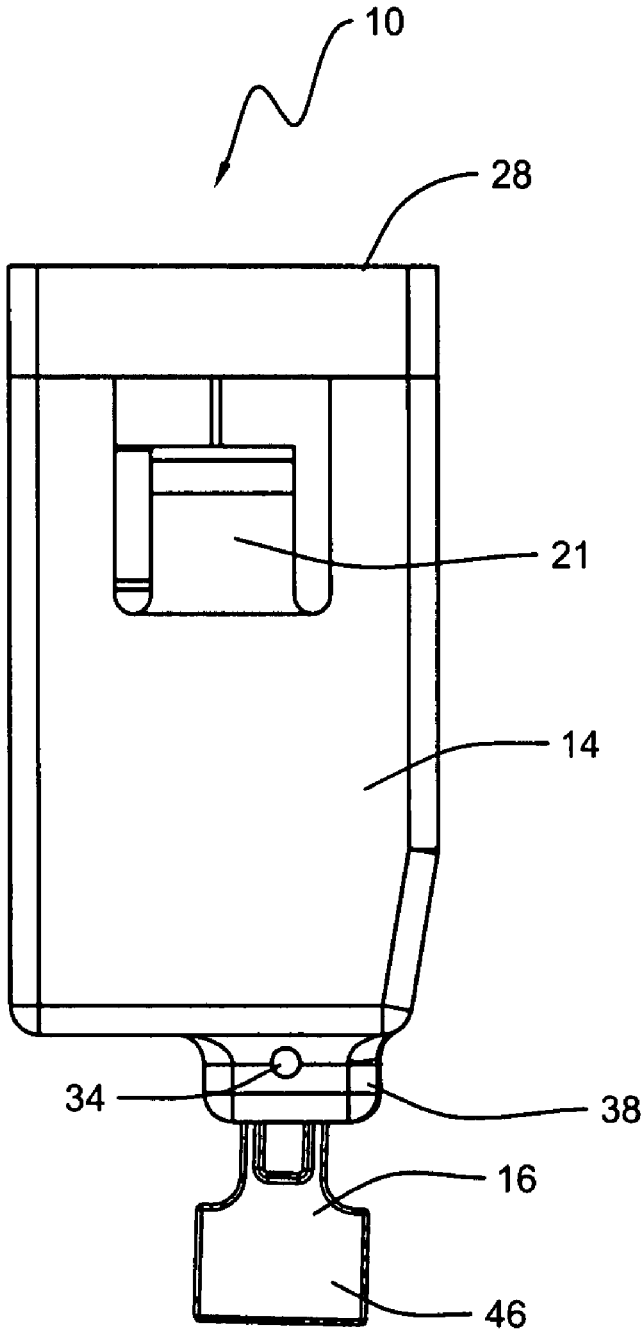
FIG. 5 is another side view of the push/push latch of FIG. 1.

Referring to FIGS. 1-3, the latch body 12 may define a track 22 on one side of the latch body 12. The track 22 is formed by grooves and angled surfaces that define a path to allow the pin 20 to travel within the grooves and along the angled surfaces, as understood in the art. The pin 20 will follow the track during the push/push operation of the latch 10, i.e., during the opening and closing of the latch, and the position of the pin 20 relative to the track determines whether the latch is open or closed. For example, when the pin 20 is at the bottom of the track 22, near end 24 of the latch body 12, the latch 10 will be in an open position and the latch body 12 will extend out from opening 26 in end 28 of the housing 14. When the pin 20 is positioned at the top of the track 22, and seated in notch 30 formed in the latch body 12, the latch 10 will be in a closed position and the latch body 12 will be positioned within the housing 14.

The pin 20 may be attached to the follower 18. The follower 18 moves within an opening or slot 32 extending along the housing 14 and along opposing rails 33 positioned on opposite sides of the opening or slot 32. This movement occurs while the pin 20 moves within the track 22. That is, as the pin 20 moves along the track 22, the follower 18 will slide back and forth along the rails 33. This slidable movement permits the latch body 12 to move relative to the housing 14, thereby permitting the opening and closing of the latch 10. The latch body 12 may also define a hook-shaped member 23 for receiving a component part of a compartment, for example.

It should be understood that other track 22 configurations are possible with the invention. It should further be understood that other configurations of the latch body, latch housing, pin and follower are possible and that the illustrated embodiment is merely exemplary of the many possible configurations that may be used with the present invention. It should also be understood that the latch may contain a spring positioned within the housing and between an inner wall of the housing and the latch body in order to help facilitate the opening and closing of the latch, as understood in the art. The latch may be made of any suitable material, including plastic.

In one embodiment, the latch 10 may include a hammer 16 which may be mounted to one end of the latch housing 14. The hammer 16 may be mounted to the housing 14 by a pin 34 connected between two outwardly extending housing portions 38, 40, or may be mounted by any other suitable technique. The pin 34 permits pivoting movement of the hammer 16 relative to the housing 14. In one embodiment, the hammer 16 may include a head 42 defining a curved head portion 44. The hammer 16 may also define a counter-weight 46 positioned opposite the head. As further explained below, in the event of a g-force condition, the counter-weight 46 will pivot about the pin 34 causing the head 42 to move into the path of travel of the latch body, thereby preventing further movement of the latch body 12 and thus preventing the latch body from moving to an open or unlatched position. As used herein, the term "hammer" refers to any device that, in the event of a g-force condition, may move into or otherwise obstruct the path of movement of the latch body or otherwise prevent the opening of the latch. The "hammer" may or may not necessarily include a counter-weight or a head portion, and may or may not necessarily pivot about a pivot point. Consequently, there are numerous hammer type devices that could be used with and are considered a part of the present invention.

Figure 6:
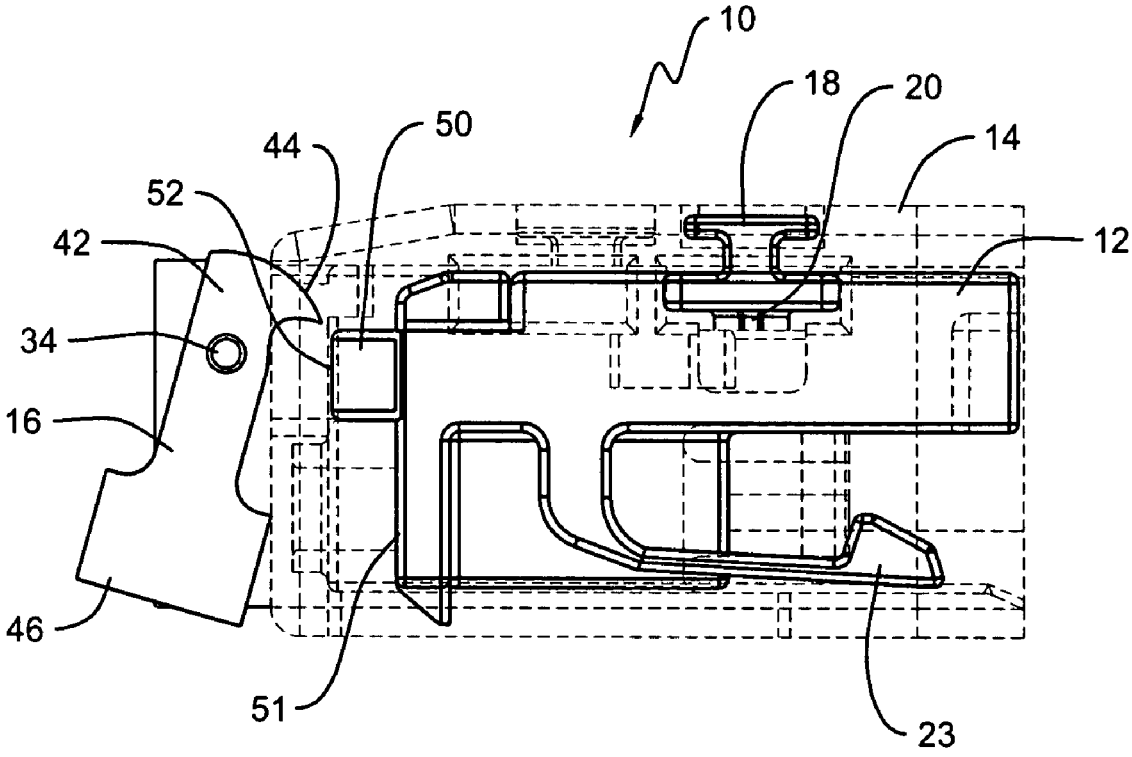
FIG. 6 is a side view of the push/push latch of FIG. 1 with the housing transparent to illustrate the latch body and an exemplary hammer, the hammer is shown in a neutral position when no g-force is applied.
Figure 7:
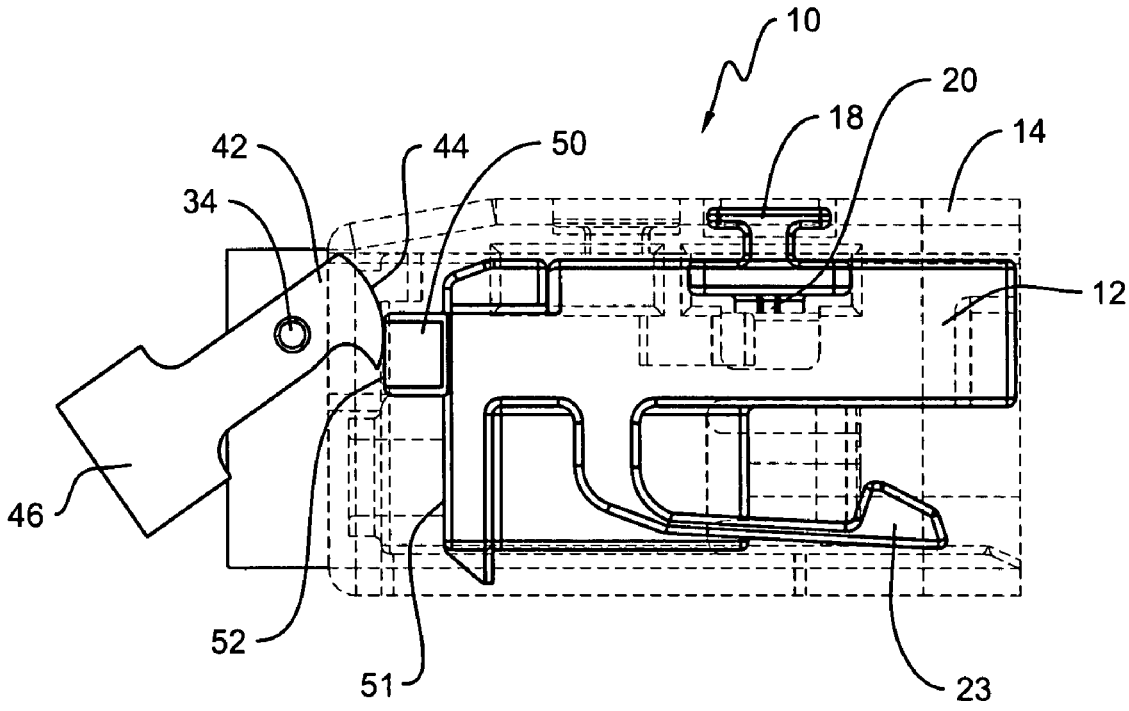
FIG. 7 is a side view of the push/push latch of FIG. 1 with the housing transparent to illustrate the latch body and an exemplary hammer, the hammer is shown in contact with the latch body when a g-force is applied.

Referring to FIGS. 6 and 7, the latch body 12 may include a protrusion 50 extending outward from end 51 of the latch body 12. The protrusion 50 may define a contact surface 52 that will contact the hammer head 42 of the hammer 16 during a g-force condition. That is, when the latch 10 is subject to a g-force condition, such as during a vehicle crash, the hammer counter-weight 46 will rotate about the connecting pin 34 until the hammer head 42 moves into the path of travel of the latch body 12. As the g-force condition causes the latch body 12 to move within the housing 14, the protrusion 50 will contact the hammer head 42 which will stop further movement of the latch body 12 thus preventing the latch body from moving to an open or unlatched position, as illustrated by FIG. 7. As shown in FIG. 6, when the g-force condition has dissipated or when no g-force is exerted on the latch 10, the counter-weight 46 causes the hammer head 42 to rotate back to its original or neutral position. When in this position, the latch 10 will be fully operational.

Figure 8:
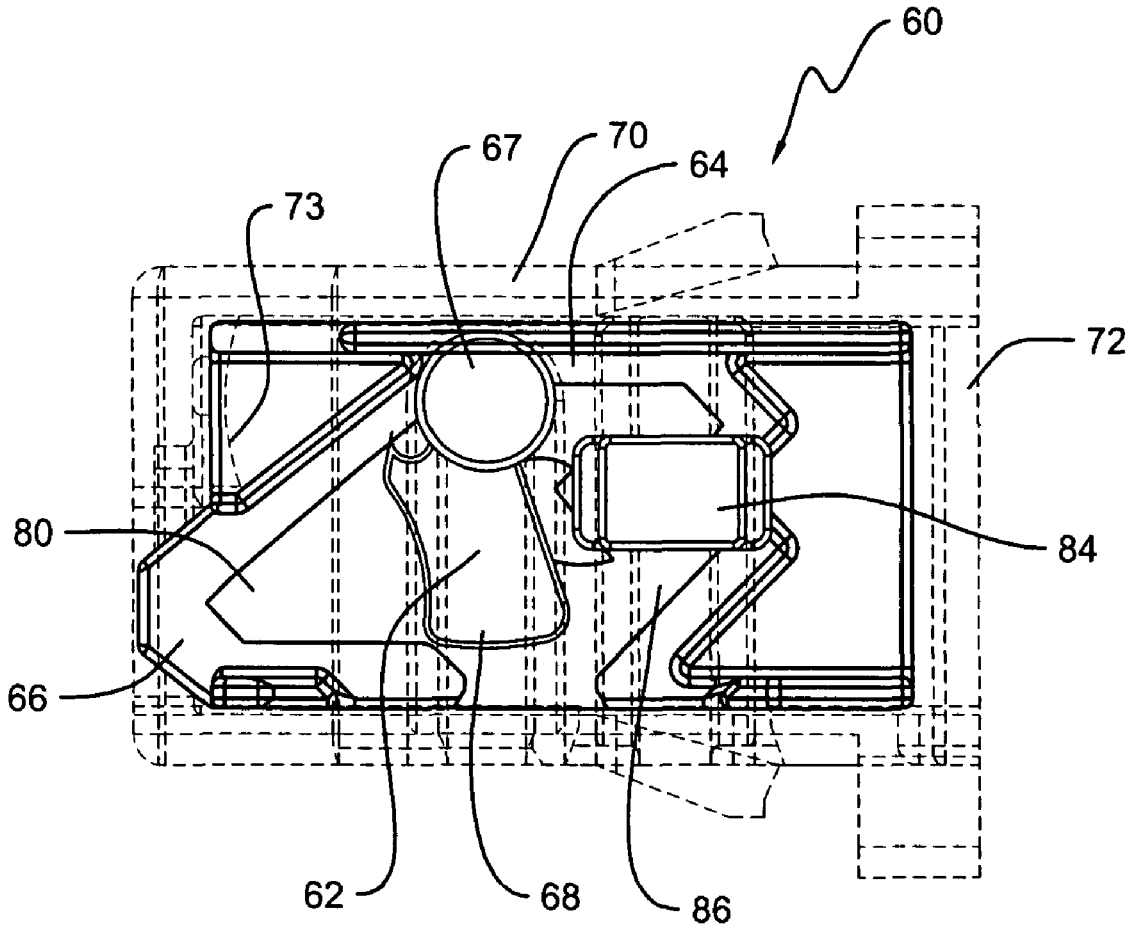
FIG. 8 is a top plan view of an alternative embodiment of a push/push latch of the invention with the housing transparent to illustrate the latch body and an exemplary hammer, the hammer is shown in a neutral position when no g-force is applied.
Figure 9:
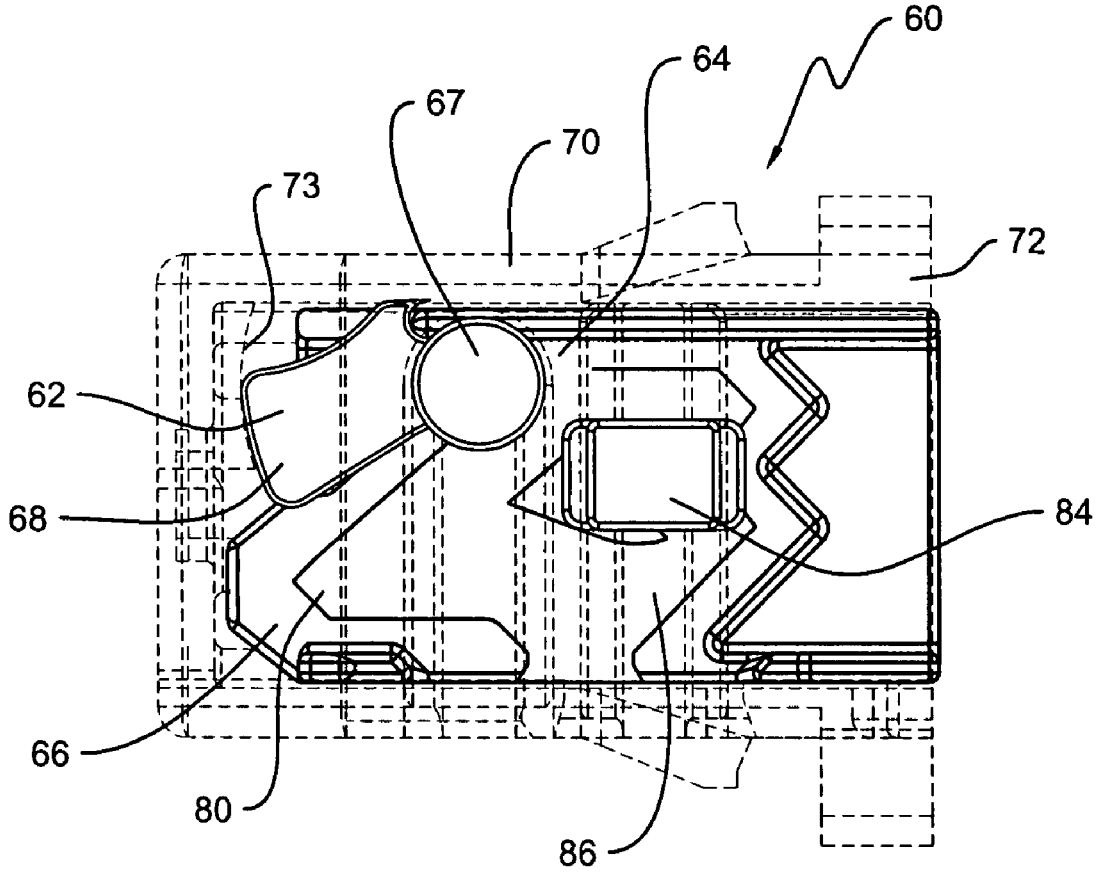
FIG. 9 is a top plan view of the alternative embodiment of FIG. 8 with the housing transparent to illustrate the latch body and exemplary hammer, the hammer is shown in contact with an inner wall of the housing when a g-force is applied.

Referring to FIGS. 8-9, in another exemplary embodiment, the latch 60 may include a hammer 62 mounted to a top surface 64 of the latch body 66 through the use of a pin 67 or other suitable mounting technique. The hammer 62 may include a counter-weight portion 68 and may rotate about the pin 67. Similar to the embodiment described above, the latch 60 may include a housing 70 defining an open end 72 through which will extend the latch body 66, and may also include a pin and follower 84. The housing 70 may also include an interior contact wall or surface 73 that, as described below, will serve as a contact point for the counter-weight portion 68 in the event of a g-force condition. The contact surface 73 may be configured to mate with the configuration of the hammer. The latch body 66 may also include a track 80 that receives the pin connected to the follower 84. The follower 84 may be mounted to a slot 86 formed in the housing 70 and the track, pin, follower and slot connection may operate in a manner similar to that described above.

With this embodiment, when a g-force is exerted on the latch 60, the counter-weight portion 68 of the hammer 62 will rotate about the pin 66 and reposition itself such that the counter-weight portion 68 will contact the contact surface 73, as shown in FIG. 9. When in this position the contact surface 73 will stop the latch body 66 from moving further, thereby preventing the opening of the latch 60. As illustrated in FIG. 8, when no g-force is exerted on the latch 60, the hammer 62 will return to its original or neutral position, and the latch 60 will be fully operational.

Figure 10:
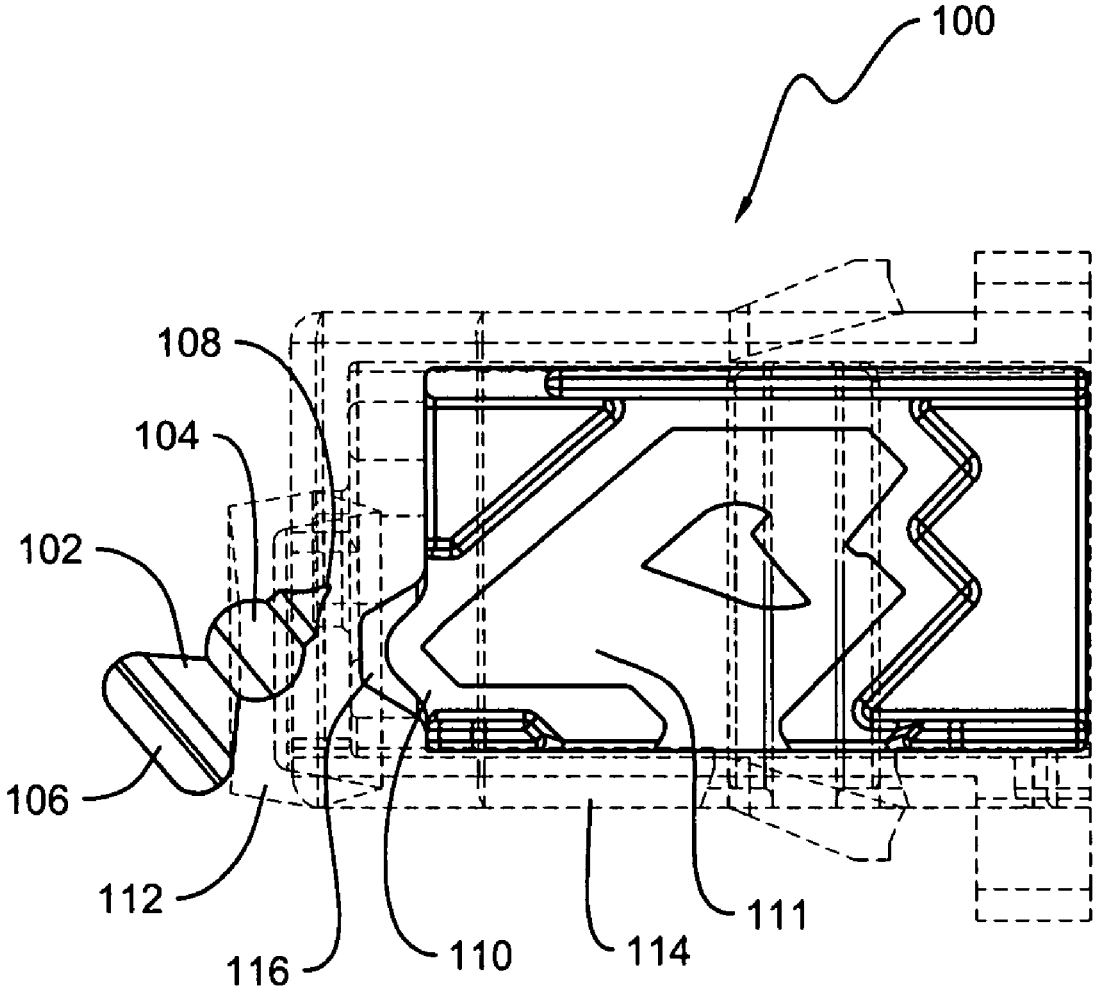
FIG. 10 is a top plan view of an alternative embodiment of a push/push latch of the invention with the housing transparent to illustrate the latch body and an exemplary hammer, the hammer is shown in a neutral position when no g-force is applied.
Figure 11:
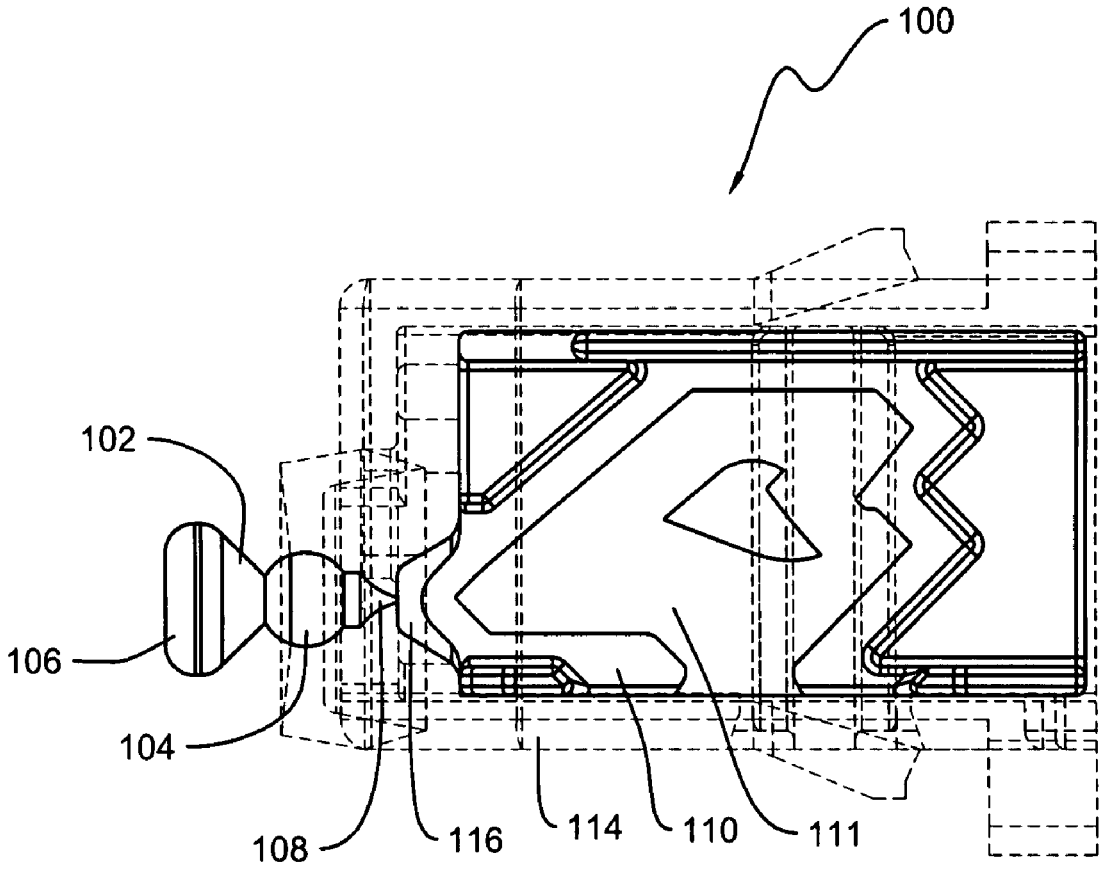
FIG. 11 is a top plan view of the alternative embodiment of FIG. 10 with the housing transparent to illustrate the latch body and exemplary hammer, the hammer is shown in contact with the latch body when a g-force is applied.

Referring to FIGS. 10-11, in another exemplary embodiment, a latch 100 may include a hammer 102 that defines a conical portion 104 and a hammer head 106, which may define a bulbous-like member that may further define a counter-weight. The conical portion 104 may include a pin end 108 that, in use, may contact the latch body 110 in the event of a g-force condition to stop further movement of the latch body 110. Similar to the other embodiments, the latch body 110 may define a path 111 for receiving the pin of the follower, which may slide along a slot formed in the housing 114, as described above.

The hammer 102 may be mounted to a back wall 112 of a housing 114 by any suitable technique. As illustrated by FIG. 10, the hammer 102 in a neutral position will hang downward, prior to a g-force condition. During a g-force condition, as shown in FIG. 11, the hammer head 106 will pivot causing the pin end 108 on the conical portion 104 to contact a protrusion 116 extending from the latch body 110. In this position, the pin end 108 stops further movement of the latch body 110, which prevents the latch 100 from opening.

Figure 12:
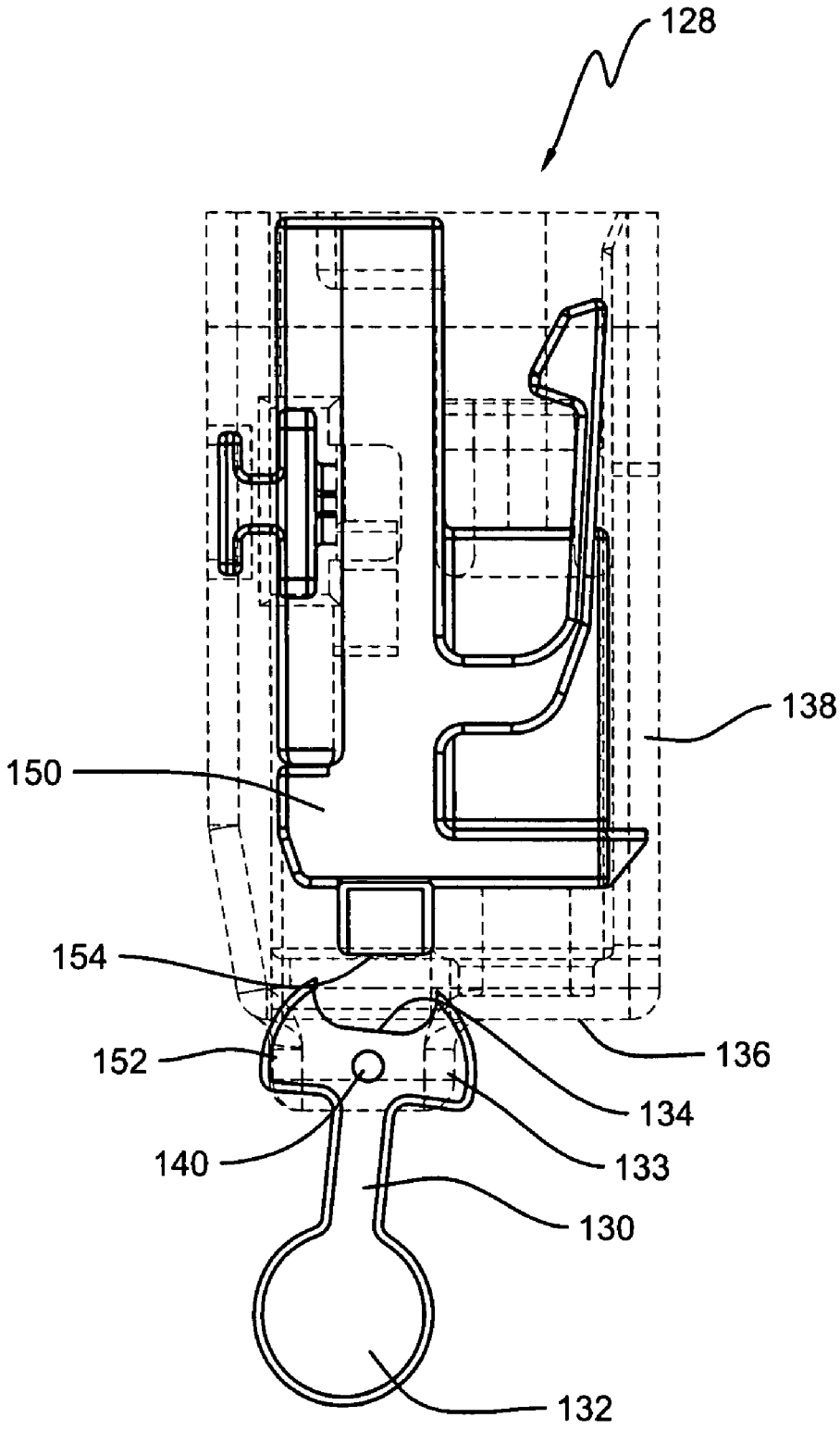
FIG. 12 is a side view of an alternative embodiment of a push/push latch of the invention with the housing transparent to illustrate the latch body and an exemplary hammer, the hammer is shown in a neutral position when no g-force is applied.
Figure 13:
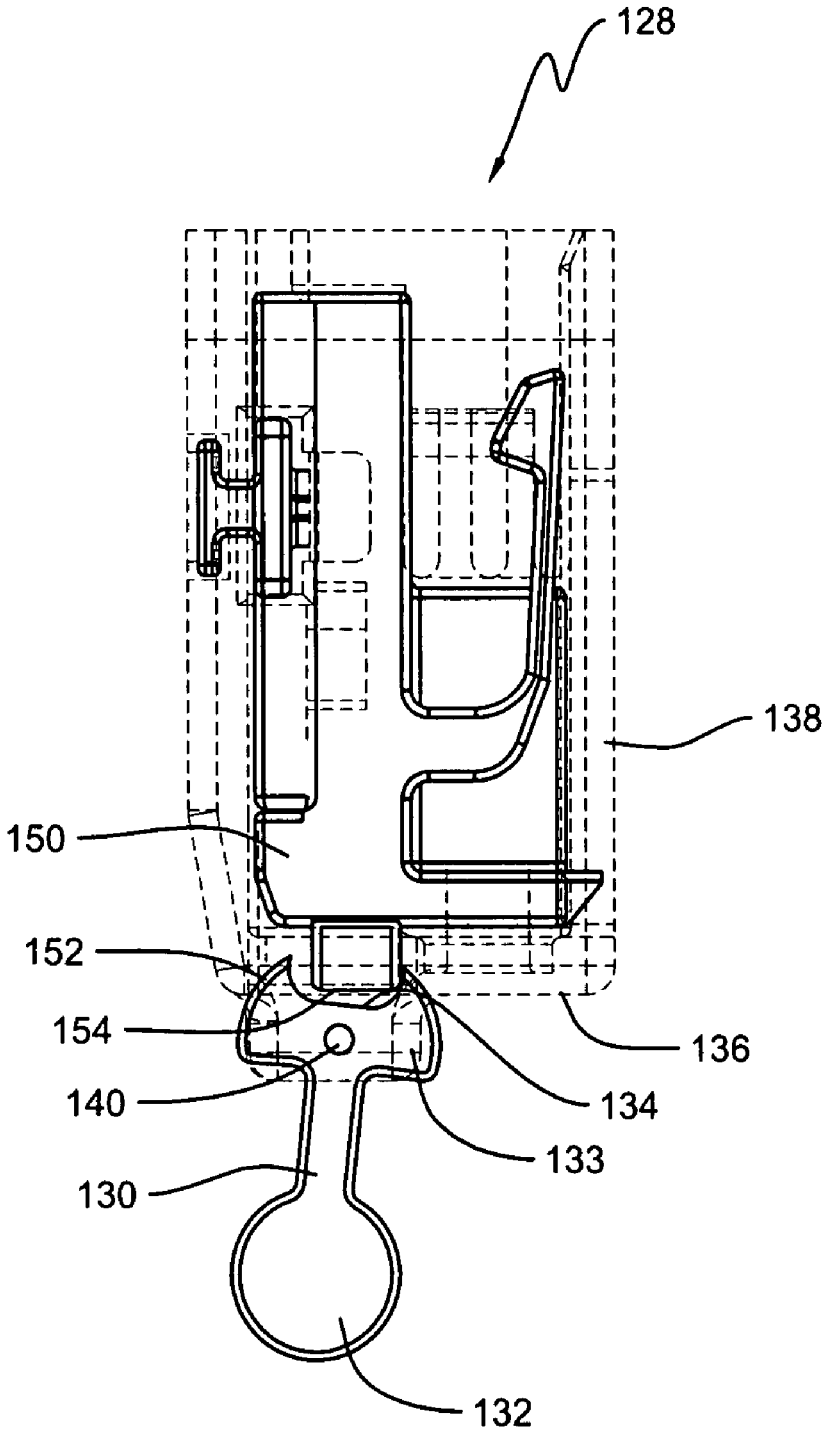
FIG. 13 is a side view of the alternative embodiment of FIG. 12 with the housing transparent to illustrate the latch body and an exemplary hammer, the hammer is shown in a neutral position when no g-force is applied and the latch body is shown in a fully extended position within the housing.
Figure 14:
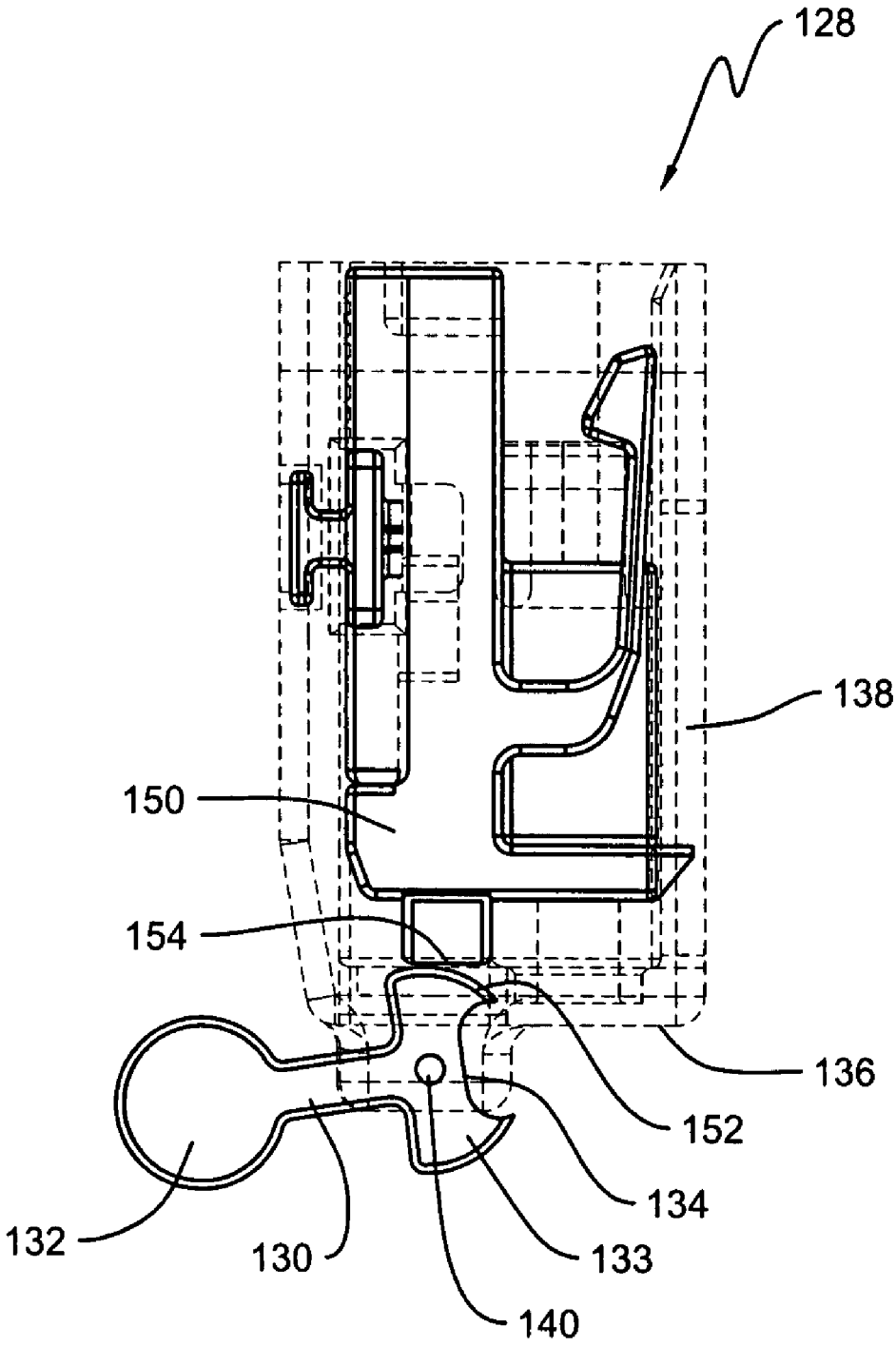
FIG. 14 is a top plan view of the alternative embodiment of FIG. 12 with the housing transparent to illustrate the latch body and exemplary hammer, the hammer is shown in contact with the latch body when a g-force is applied.

Referring to FIGS. 12-14, in yet another exemplary embodiment, a latch 128 that may be used in a vertical mounting application is depicted. The latch 128 may include a track, pin, follower and slot similar to the other embodiments. The latch 128 may include a hammer 130. The hammer 130 may include at one end a counter-weight 132. At the opposite end, the hammer 130 may define a hammer head 133 further defining a notch 134. The hammer 130 may be connected to a back wall 136 of a housing 138 by a pin 140 and between two protruding members of the housing 138, as described above, or by any other suitable technique. The pin 140 permits pivoting movement of the hammer 130 relative to the housing 138.

In this embodiment, the notch 134 permits the latch body 150 to move freely within the housing 138, as illustrated by FIGS. 12-13, which show movement of the latch body into the notch 134 during normal operation. During a g-force condition, the counter-weight 132 of the hammer 130 may rotate about pin 140 and a side 152 of the hammer head 133 may contact a protrusion 154 extending from the latch body 150, as illustrated in FIG. 14. In this position, the hammer head 133 and specifically the side 152 of the hammer head will stop further movement of the latch body 150 relative to the housing 138 and thus will prevent the opening of the latch. After the g-force condition has dissipated, the hammer 130 will return to its original or neutral position, as shown by FIG. 12, and the latch will be fully operational.

As should be readily apparent, the hammer of the invention may define numerous configurations and may operate in a variety of different ways. With each of the embodiments described herein, the hammer is configured to stop the movement of the latch body when both high and low g-forces are exerted on the latch. Also, with each embodiment, after the g-force condition has dissipated, or when there is no g-force condition, the hammer returns to its original or neutral position to allow the latch to be opened or closed, as desired. Moreover, with each embodiment, a spring may be positioned between the housing and the latch body in order to facilitate the opening and closing of the latch. It should be understood that with the invention, the latch may be mounted in a vertical or a horizontal position.

Moreover, with each embodiment, a coating or layer of viscous grease may be applied to the track in order to inhibit the free movement of the pin and follower and to further prevent the unintended opening of the latch in the event of a g-force condition. For example, during a g-force condition, the coating of grease on the track will inhibit movement of the pin in the track during the moment or split-second it takes for the hammer to move into the path of travel of the latch body, thus stopping movement of the latch body. The grease may be applied on the track and/or pin using any suitable technique. The grease may be any suitable grease such as Kilopoise grease manufactured by Rocol®, which provides a suitable sticky surface to hinder the free movement of the pin in the track.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A push latch mechanism comprising:

a housing defining a slot;

a latch body defining a track, the latch body positioned within the housing and movable relative to the housing, wherein the relative movement of the latch body defines a path of travel;

a follower positioned in the slot, the follower defining a pin extending outward from the follower and in engagement with the track, wherein the pin moves along the track while the follower moves along the slot; and a hammer mounted to the housing, the hammer defining a head and a counterweight, wherein the hammer is movable between a first position and a second position, wherein in the first position the head does not obstruct the path of travel of the latch body, and wherein in the second position the head obstructs the path of travel of the latch body, thereby preventing the latch mechanism from opening, such that when moving from the first position to the second position on account of a g-force condition, the counterweight moves in a first direction, and such that when the g-force condition has sufficiently dissipated, the counterweight alone causes the hammer to move back to the first position in a direction that is opposite the first direction.

2. The push latch mechanism of claim 1 wherein the hammer is pivotally mounted to the housing.

3. The push latch mechanism of claim 2 wherein the hammer is mounted to the housing through the use of a pin.

4. The push latch mechanism of claim 3 wherein the counter-weight is configured on the hammer at an end opposite the head.

5. The push latch mechanism of claim 1 wherein the hammer defines a conical portion and a pin extending outward from the conical portion.

6. The push latch mechanism of claim 1 wherein the head defines a notch.

7. The push latch mechanism of claim 6 wherein when the head is in the first position the notch does not obstruct the path of travel of the latch body.

8. The push latch mechanism of claim 7 wherein when the head is in the second position, the head obstructs the path of travel of the latch body.

9. The push latch mechanism of claim 1 wherein the latch body defines a protrusion extending outwardly from the latch body, and wherein when the head is in the second position, the head contacts the protrusion of the latch body.

10. The push latch mechanism of claim 1 further comprising a layer of grease on the track of the latch body.

11. The push latch mechanism of claim 1 wherein the hammer is pivotally mounted to the latch body.

12. The push latch mechanism of claim 11 wherein the hammer is mounted to the latch body through the use of a pin.

13. The push latch mechanism of claim 11 wherein the housing includes an interior wall, and wherein in the second position, the head contacts the interior wall of the housing.

14. The push latch mechanism of claim 13 wherein the head defines a configuration that mates with a configuration of the interior wall of the housing.

15. A push latch comprising:

a housing defining opposing rails;

a latch body defining a track, the latch body positioned within the housing and movable relative to the housing, wherein the relative movement of the latch body defines a path of travel;

a follower positioned on the opposing rails, the follower defining a pin extending outward from the follower and in engagement with the track, wherein the pin moves along the track while the follower moves along the opposing rails; and a hammer pivotally mounted to the housing so as to freely move back and forth between a first position and a second position solely in response to g-force conditions, the hammer defining a head at one end and a counter-weight at an opposing end, wherein in the first position the head does not obstruct the path of travel of the latch body, and wherein in the second position the head obstructs the path of travel of the latch body, thereby preventing the latch mechanism from opening.

16. The push latch mechanism of claim 15 wherein the head defines a notch, wherein when the head is in the first position the notch does not obstruct the path of travel of the latch body, and wherein when the head is in the second position, the head obstructs the path of travel of the latch body.

17. The push latch mechanism of claim 16 further comprising a layer of grease on the track of the latch body.

* * * * *